United States Patent [19]

Oelberg

[11] 4,164,293

[45] Aug. 14, 1979

[54] PACKER AND LOADER UNIT FOR A MOTOR VEHICLE

[76] Inventor: George R. Oelberg, 1515 Ray Rd., Hyattsville, Md. 20782

[21] Appl. No.: 856,684

[22] Filed: Dec. 1, 1977

[51] Int. Cl.[2] ..... B65F 3/00

[52] U.S. Cl. ..... 414/525; 414/537

[58] Field of Search ..... 214/82, 83.3, 85, 85.1, 214/77 P, 78, 146.5; 296/61

[56] References Cited

U.S. PATENT DOCUMENTS

| | | | |
|---|---|---|---|
| 2,439,001 | 4/1948 | Hippard | 214/82 X |
| 3,584,755 | 6/1971 | Smith | 214/83.3 |
| 3,799,376 | 3/1974 | Herpich | 214/83.3 |
| 3,834,565 | 9/1974 | Goodman, Jr. | 214/85 |
| 4,057,154 | 11/1977 | Neufeldt | 214/83.3 X |
| 4,078,682 | 3/1978 | Johnson, Jr. | 214/83.3 |
| 4,121,725 | 10/1978 | Demenais | 214/83.3 |

*Primary Examiner*—Francis S. Husar
*Assistant Examiner*—Terrance L. Siemens
*Attorney, Agent, or Firm*—Edmund M. Jaskiewicz

[57] ABSTRACT

A packer and loader unit includes a container which may be mounted on the frame of a truck or mounted upon a frame of a trailer. A front support assembly normally disposed at the forward end of the container is connected by a displacing means to a rear support assembly normally disposed at the rear of the container. A tail gate is pivotally mounted on the rear support assembly and has a forward portion engageable with a wall just below the floor of the container at the rear thereof. Displacing of the rear support assembly toward the front support assembly when the latter is locked in position will cause the tail gate to pivot from a down-ramp position to an up-position which may be substantially vertical so as to close off the rear end opening of the container. Locking the rear support assembly in position and actuating the displacing means will cause the front support assembly to move rearwardly in the container.

13 Claims, 7 Drawing Figures

FIG. 1
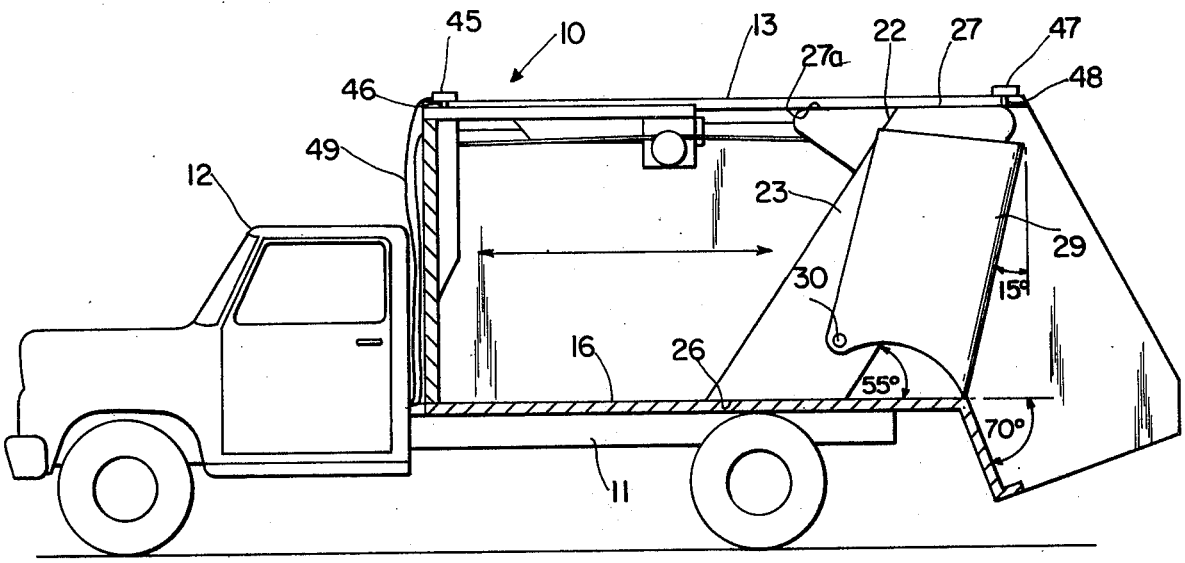
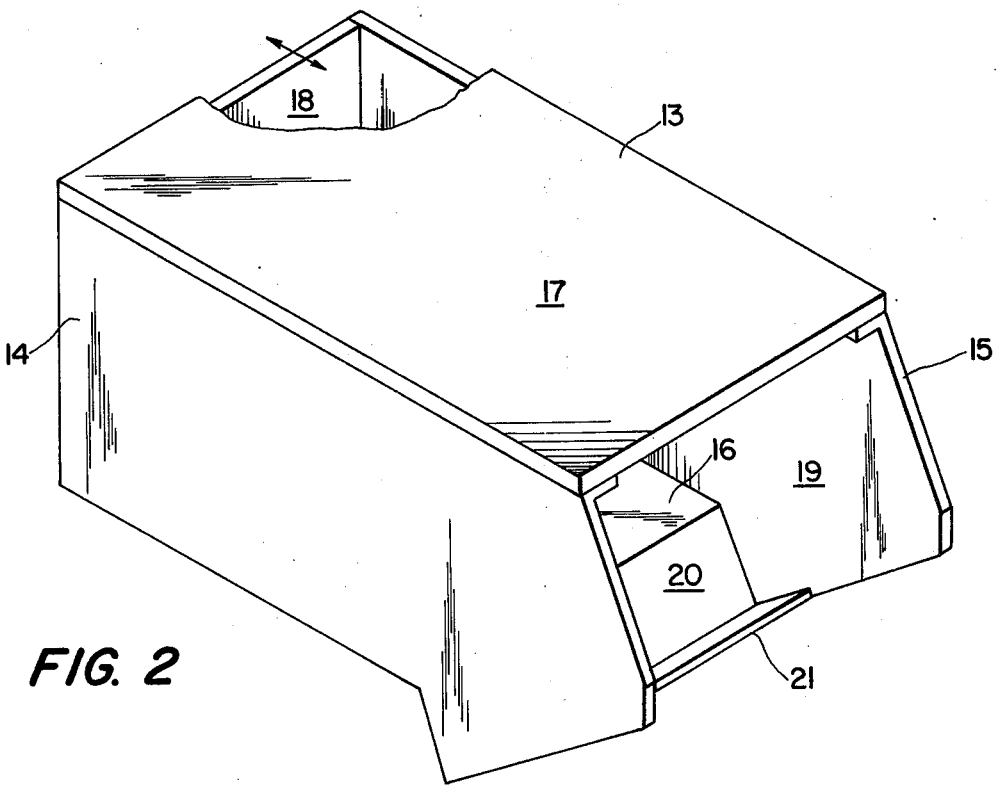
FIG. 2

PACKER AND LOADER UNIT FOR A MOTOR VEHICLE

The present invention relates to an apparatus for loading and unloading of trucks or other vehicles, more particularly, to a packing and loading unit which can be mounted on the frame of a truck.

Various forms of truck bodies have been constructed in order to facilitate the loading and unloading of particular materials with respect to the truck. Trash and refuse trucks are examples of specialized forms of loading and unloading apparatus. In such trucks a hopper or some other container is lowered to a position close to the ground to facilitate the placing of material in the hopper. The hopper is then elevated to a position from which the material is dumped from the hopper into a body or container mounted on the frame of the truck. These structures as commonly employed in trash or refuse trucks are constructed to perform a particular function and thus are not readily adaptable to perform functions other than the loading or unloading of trash and refuse.

Various forms of material-handling apparatus have been constructed so as to be added to or incorporated into a truck body to facilitate the placing or removing of objects from the truck. These structures are also characterized by being intended to perform specialized functions and are not readily adaptable to functions other than those for which they were originally intended. Because of their specialized nature these material-handling structures and also the trash and refuse truck structures described above are relatively expensive to construct. The high cost of such structures is further enhanced by the fact that these structures have relatively limited uses and are not sufficiently versatile to justify production of the material-handling structures on a large and economical scale.

It is therefore the principal object of the present invention to provide a novel and improved loading unit for a truck or other vehicle.

It is another object of the present invention to provide a packer and loader unit which is simple in construction but can be readily adapted to perform a variety of loading and unloading functions.

It is a further object of the present invention to provide such a packer and loading unit which is reliable in operation, relatively inexpensive to construct and operate and which can be mounted on the frames of existing trucks.

According to one aspect of the present invention a packer and loader unit for a vehicle may comprise a container having a rear support assembly movable horizontally within the container and positionable at the container rear end opening. A tail gate is pivotally mounted to the rear support assembly so as to be pivotable between a down-ramp position and an up-position. Means are connected to the rear support assembly for displacing the support assembly horizontally thereby pivoting the tail gate.

The unit may also comprise a front support assembly upon which the displacing means is mounted. The front and rear support assemblies may be selectively locked in position so that locking one support assembly and energizing the moving means will cause the other support assembly to move toward the locked assembly.

The front end assembly may comprise an end plate which substantially closes the front end opening of the container. The tail gate on the rear support assembly may be positioned to substantially close the rear end opening of the container when the tail gate is in its up-position.

The packer or loader unit may be mounted upon the frame of a truck or may be constructed as a separate trailer or towable unit.

Other objects and advantages of the present invention will be apparent upon reference to the accompanying description when taken in conjunction with the following drawings, which are exemplary, wherein;

FIG. 1 is a side elevational view of a truck having a loader unit according to the present invention mounted thereon with the side wall of the loader unit removed to show the structure therein;

FIG. 2 is a perspective view from the top and rear of the container of the loader unit in FIG. 1;

Proceeding next to the drawings wherein like reference symbols indicate the same parts throughout the various views a specific embodiment and modifications of the present invention will be described in detail.

Figure 3:
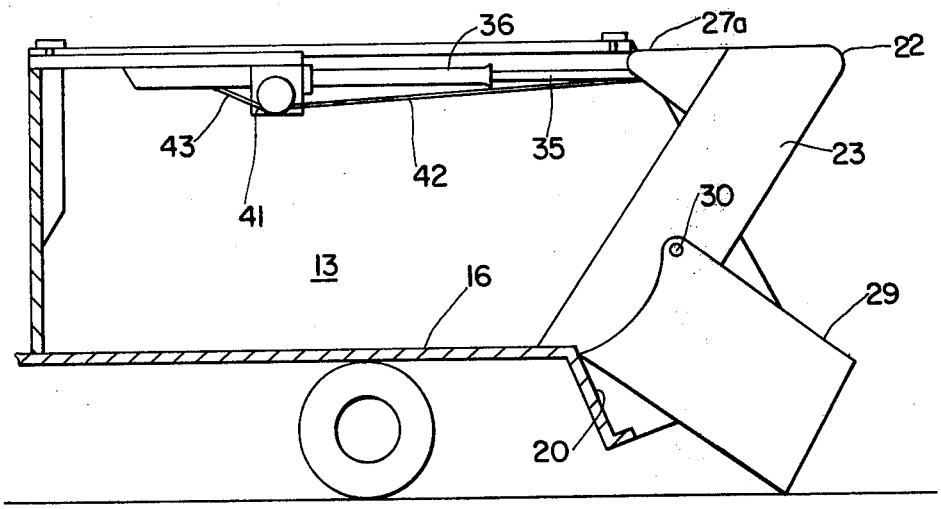
FIG. 3 is a side elevational view similar to that of FIG. 1 of the loader unit and showing the tail gate in the down-ramp position.

In FIG. 1 there is indicated generally at 10 a general purpose packer and loader unit according to the present invention with the unit being mounted on a frame 11 of a conventional one-ton pick-up truck 12 having the usual cab. While the unit 10 is particularly intended for mounting on the chassis or frame of such a truck it is to be understood that the unit may be mounted on other size trucks or vehicles or the unit may be constructed as a separate unit mounted on wheels which may be towed by a tractor or other vehicle.

The loader unit 10 comprises a container 13 which is shown in greater detail in FIG. 2. The container 13 has side walls 14 and 15 upstanding from a floor 16 and enclosed by a roof 17, a portion of which is cut away to show front end opening 18 of the container. The opposite end of the container defines a rear end opening 19. From the rear end of the floor is a substantially vertical wall 20 which defines an angle of approximately 70° with the horizontal. A reinforcing member 21 may be secured at the bottom of vertical wall 30 and between the side walls 19. The side walls 14 and 15 extend rearwardly from the vertical wall 20 in order to define a protecting structure for the tail gate which will be presently described. There is an opening between the bottoms of the end portions of the side walls 14 and 15 to enable the tail gate to be pivoted into a downward position as will be presently described.

Figure 5:
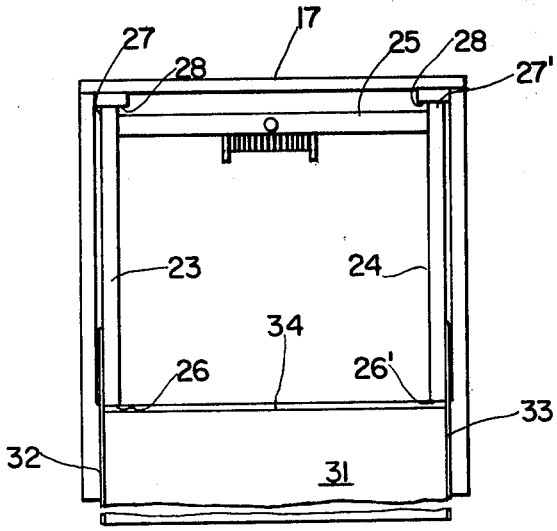
FIG. 5 is a rear elevational view of the loader unit with the tail gate down as shown in FIG. 3.

Positioned within the container as may be seen in FIG. 1 is a rear support assembly 22 which comprises a pair of inclined vertical legs 23 and 24 interconnected at their upper ends by a web or cross-beam 25. The legs 23 and 24 may be constructed of steel, aluminum or aluminum alloy structural members and are inclined at an angle of about 55° to the floor of the container as shown in FIG. 3. The bottom ends of the legs indicated at 26 and 26′ rest upon the container floor 16 so as to be slidable or displaceable horizontally upon the floor. The upper ends of the legs 27 and 27′ are provided with forwardly extending triangular reinforcing brackets 27a and are engageable with substantially horizontally extending rails or guide surfaces 28 and 28′ located as shown in FIG. 5 and which also function to strengthen the container structure.

A tail gate 29 is pivotally mounted at 30 to the legs 23 and 24. The tail gate 29 comprises a bottom wall 31 at the ends of which are upstanding side walls 32 and 33 to define a substantially U-shaped cross-section. The side walls 32 and 33 are pivotally connected by suitable pins at 30 to the legs 23 and 24. The tail gate bottom wall 31 is provided with a forward edge 34 which rests upon the floor 16 of the container when the tail gate is in its up-position as shown in FIG. 1. In this up-position, the tail gate is substantially vertical but is preferably at an angle of about 15° from the vertical. In this up-position the tail gate substantially closes the rear end opening of the container.

Extending forwardly from the web or cross-member 25 of the rear support assembly is a tubular steel supporting member 35 which is slidably received within a floating sleeve 36 which may comprise a tubular steel member having an outer diameter of approximately 4 inches–5 inches and whose inner diameter slidably receives the outer diameter of the main supporting beam 35. The floating tubular member 36 is slidably supported in a front support assembly indicated generally at 37 in FIG. 6.

Figure 6:
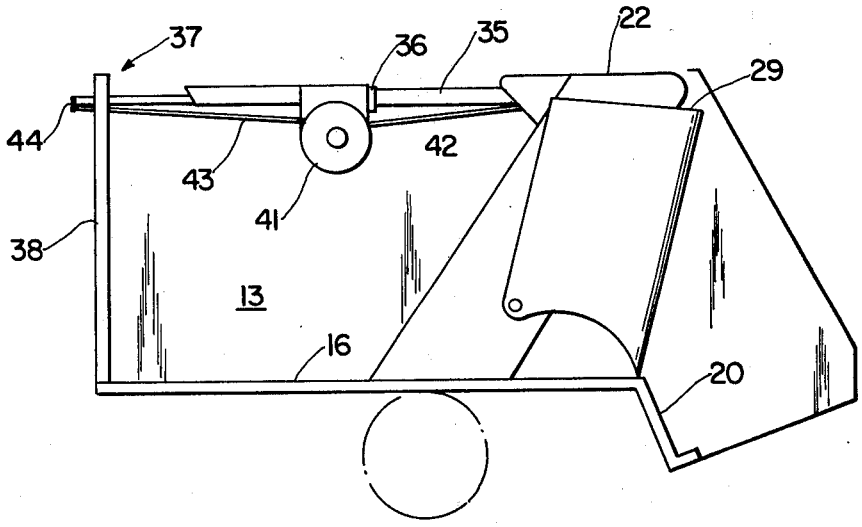
FIG. 6 is side elevational view of the front and rear support assemblies and inter-connecting power means of the loader unit according to the present invention.
Figure 7:
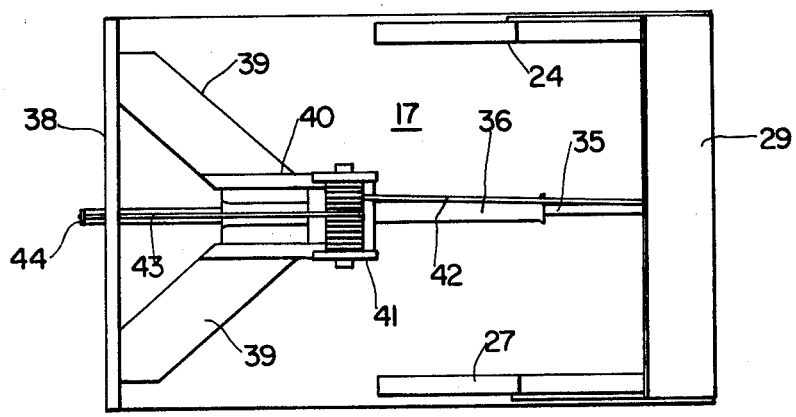
FIG. 7 is a bottom plan view of the support assembly structure as shown in FIG. 6.

The front support assembly comprises a front end plate 38 which is dimensioned to close the front end opening 18 of the container but is slidable along the floor 16 of the container. Extending rearwardly from the upper portion of the front end plate 38 are support members 39 which converge as may be seen in FIG. 7 and a mounting plate 40 is attached to this convergence of the supporting elements. The mounting plate 40 is provided with a bore having linear bearings therein to slidably receive the floating sleeve 36. A reversible winch of the self-locking type which may be electrically or hydraulically driven is indicated at 41 and is mounted on the under side of the mounting plate 40. A cable 42 is wound around the spool of the winch and connected to the crosspiece 25 of the rear support assembly 22. A second cable 43 is also wound around the spool of the winch 41 and has its end connected to the forward portion 44 of the main supporting beam 35 which, as can be seen in FIG. 6, extends outwardly of the floating sleeve 36. As can be seen in FIG. 7, the cables 42 and 43 are wound around the spool of the winch in such a direction that rotation in the winch in one direction will cause a winding of one cable and an unwinding of the other cable and rotation of the winch in the opposite direction will reverse the winding and unwinding functions of the cables.

Mounted on the front end of roof 17 of the container is a solenoid locking device 45 which actuates an armature locking pin 46 into locking engagement with the front support assembly 37. Energization of the solenoid 45 will thus cause the pin 46 to lock the front support assembly 37 against horizontal displacement.

Similarly, a rear solenoid 47 having a locking armature or pin 48 is mounted on the rear portion of container roof 17 so as to lock the rear support assembly 22 against horizontal displacement.

Power for the solenoids 45 and 47 and for the winch 41 when electric, is provided through a cable 49 which is looped in front of the container and is connected to a battery source of electrical energy located in the cab 12. Hydraulic power can also be used to drive the winch 41 but generally speaking hydraulic power is more expensive and requires more components in the form of connecting hoses and control valves.

In operation, the front support assembly 37 is locked against horizontal displacement at all times except during an unloading operation. During unloading, the rear support assembly is locked in position.

Figure 4:
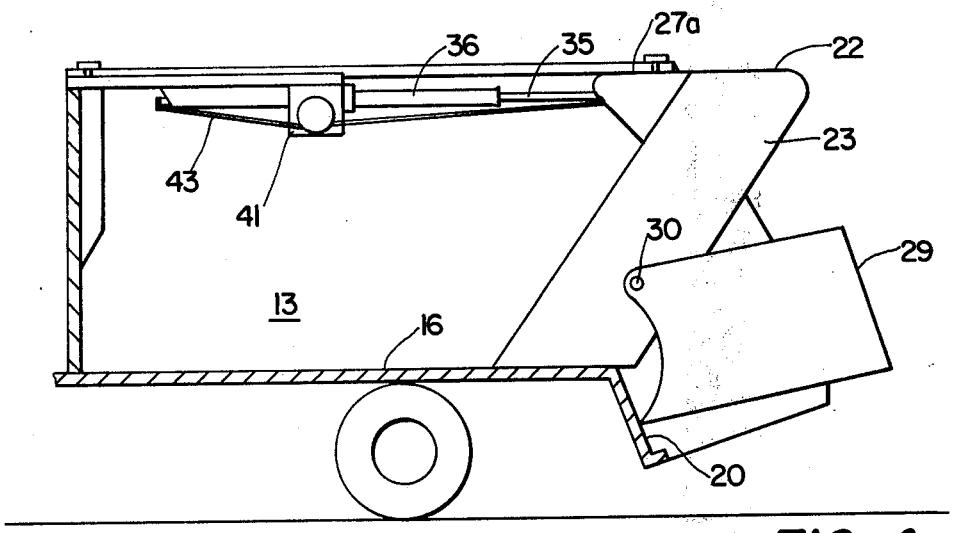
FIG. 4 is a view similar to that of FIG. 3 but showing the tail gate in an intermediate position.

When the tail gate 29 is in the up-position as shown in FIG. 1, the tail gate is pivoted downwardly to the positions of FIGS. 3 or 4 by locking the front support assembly in position against horizontal displacement and causing the winch to rotate in a direction so that cable 43 is wound to pull the front end 44 of support beam 35 toward the rear of the container. This movement causes the rear support assembly 22 to move rearwardly and the tail gate 29 will pivot downwardly because of gravity. Should the rearward movement of the rear support assembly continue to the position as shown in FIG. 3, the tail gate will be in the down-ramp position wherein the forward edge 34 of the tail gate will be supported against vertical wall 20 just below the floor 16 of the container and the outer end of the tail gate will be on the ground to define a ramp. In this position, material such as heavy equipment, automobiles or the like can be moved up the ramp into the container. Loading of automobiles or heavy equipment is facilitated by locking the rear support assembly in the position as shown in FIG. 3 and by unlocking the front support assembly 22. The front support assembly is then moved rearwardly and a cable attached to the front support assemble is connected to the automobile or other equipment to be moved. The winch 41 is then driven so as to rotate in a direction to move the front support assemble forwardly. This forward movement of the front support assemble will then pull the automobile up the tail gate ramp and into the container.

For the loading of materials such as grain, gravel, refuse or the like, the tail gate can be stopped in the substantially horizontal position as shown in FIG. 4. The material then can be loaded on to the tail gate and when the tail gate is loaded the rear support assembly is then moved forwardly by turning the winch 41 in a direction to wind the cable 42 thereon. This forward movement of the rear support assembly will cause the forward end 34 of the tail gate to pivot against the vertical wall 20 until the tail gate pivots upwardly into its up-position as shown in FIG. 1.

When bulk material such as leaves, grain or paper trash are loaded into the container, the material can be compacted by the continued movement of the rear support assembly forwardly when the tail gate 29 is in the up-position. The compact of the contents of the container will not be complete because of the presence of the supporting sleeve 36. However, the material can be compacted to about one-third of the length of the container.

Cables, chains or other locking devices may be employed to limit the downward pivoting of the tail gate so as to position the tail gate in a desired position for a particular loading function.

When the tail gate is in the down-ramp position as shown in FIG. 3, the unit can be used for picking up of snow from a road or other surface by backing the vehicle having the unit thereon into the snow. The snow is then scooped up the tail gate and pushed into the container.

In a similar manner, the tail gate can be considerably strengthened and the entire unit reinforced to enable the unit to be used in strip mining whereby a strip of dirt having a thickness of 1–2 feet can be scooped from the ground by backing the vehicle so that the lower end of the tail gate acts as a scoop. For such an application, it may be desirable to build the unit as a complete vehicle with a driver's cab positioned so that the operator faces toward the rear of the container.

Since the tail gate is pivoted downwardly by gravity and is pivoted upwardly by engaging a fulcrum surface during movement of the rear support assembly the only power unit required is the winch. Driving the winch in the desired direction brings about a pivoting upwardly or downwardly of the tail gate, a compacting of the contents, assisting in loading by using the moving front support assemble to pull a load into the container.

The tail gate is made of plate steel and is suitably reinforced and weighted so as to be pivotable under the action of gravity as described above. The support elements of the front and rear support assemblies may be made of tubular steel or aluminum elements, preferably having a square cross-section. By constructing the supporting elements according to the relationships as disclosed herein the loading unit is self-contained and self-reinforcing so that the unit can perform a wide variety of loading or unloading functions.

The cables 42 and 43 may be wound around the top of the spool, as in FIG. 1, or around the bottom of the spool as in FIGS. 3, 4 and 7, depending on the position of the winch with respect to the support beam 35.

Only a single cable can be used with the ends of the cable being connected to the supporting beam 35 and to the cross-piece 25 and the central portion of the cable being wound several turns around the spool of the winch.

It will be understood that this invention is susceptible to modification in order to adapt it to different usages and conditions, and accordingly, it is desired to comprehend such modifications within this invention as may fall within the scope of the appended claims.

What is claimed is:

1. A packer and loader unit for a vehicle comprising a container having a floor and a rear end opening, a rear support assembly displaceable horizontally within said container and positionable at said rear end opening, a tail gate pivotally mounted to said rear support assembly and pivotable between a down-ramp position and an up-position, and means connected to said rear support assembly for displacing said rear support assembly horizontally to allow said tail gate to pivot.

2. A packer and loader unit as claimed in claim 1 wherein said tail gate is selectively positionable in positions intermediate said down-ramp and up-positions.

3. A packer and loader unit as claimed in claim 1 wherein said tail gate is inclined from said container floor at the rear end opening to a ground surface upon which the vehicle is disposed in said down-ramp position, said tail gate being in one of substantially vertical to close said rear end opening and intermediate said vertical and down-ramp positions.

4. A packer and loader unit as claimed in claim 1 wherein said rear support assembly comprises an inverted substantially U-shaped member having a web and a pair of legs depending therefrom, the ends of said legs resting upon said container floor.

5. A packer and loader unit for a vehicle as claimed in claim 4 wherein said legs are inclined from said web in a direction away from said rear end opening.

6. A packer and loader unit as claimed in claim 1 wherein said tail gate is substantially U-shaped and has a bottom wall and side walls upstanding therefrom.

7. A packer and loader unit as claimed in claim 6 wherein said tail gate side walls are pivotally connected to said rear support assembly.

8. A packer and loader unit as claimed in claim 7 and a substantially vertical surface extending downwardly from the rear end of the container floor, said tail gate bottom wall having a forward edge engaging the upper portion of said vertical surface such that horizontal displacement of said rear support assembly away from said rear end opening will pivot said tail gate against said vertical surface.

9. A packer and loader unit as claimed in claim 7 wherein the pivotal mounting of said tail gate is such that said tail gate pivots toward the down-ramp position by gravity when said rear support assembly is displaced toward the container rear opening.

10. A packer and loader unit as claimed in claim 1 wherein said container has a front end, a front support assembly disposed at said container front end, said displacing means being mounted on said front support assembly.

11. A packer and loader unit as claimed in claim 10 wherein said front support assembly comprises an end plate substantially closing the front end of said container.

12. A packer and loader unit as claimed in claim 10 wherein said displacing means comprises an elongated element extending from said rear support assembly and slidably received on said front support assembly, and reversible power means interconnected between said rear support assembly and a forward portion of said elongated element for moving said rear support assembly toward and away from said front support assembly.

13. A packer and loader unit as claimed in claim 10 and further comprising means on said container for locking selectively said front and rear support assemblies against horizontal displacement.

* * * * *